US012187329B2

(12) United States Patent
Prill

(10) Patent No.: US 12,187,329 B2
(45) Date of Patent: Jan. 7, 2025

(54) REGENERATIVE ENERGY ABSORPTION DEVICE, COUPLING OR JOINT ARRANGEMENT HAVING AN ENERGY ABSORPTION DEVICE OF THIS KIND, AND DAMPING ARRANGEMENT HAVING AN ENERGY ABSORPTION DEVICE OF THIS KIND

(71) Applicant: VOITH PATENT GMBH, Heidenheim (DE)

(72) Inventor: Thomas Prill, Hannover (DE)

(73) Assignee: VOITH PATENT GMBH, Hannover (DE)

( * ) Notice: Subject to any disclaimer, the term of this patent is extended or adjusted under 35 U.S.C. 154(b) by 671 days.

(21) Appl. No.: 17/595,666

(22) PCT Filed: May 14, 2020

(86) PCT No.: PCT/EP2020/063452
§ 371 (c)(1),
(2) Date: Nov. 22, 2021

(87) PCT Pub. No.: WO2020/239458
PCT Pub. Date: Dec. 3, 2020

(65) Prior Publication Data

US 2022/0219741 A1 Jul. 14, 2022

(30) Foreign Application Priority Data

May 24, 2019 (DE) ..... 10 2019 113 907.4

(51) Int. Cl.
*B61G 9/06* (2006.01)
*B61G 9/20* (2006.01)
*B61G 9/24* (2006.01)

(52) U.S. Cl.
CPC ..... *B61G 9/06* (2013.01); *B61G 9/20* (2013.01); *B61G 9/24* (2013.01)

(58) Field of Classification Search
CPC . B61G 9/06; B61G 11/16; B61G 9/00; B61G 9/20; B61G 9/04; B61G 9/24
See application file for complete search history.

(56) References Cited

U.S. PATENT DOCUMENTS

2006/0043044 A1* 3/2006 Ring ..... B61G 9/06 213/75 R
2006/0117843 A1 6/2006 Reck et al.
(Continued)

FOREIGN PATENT DOCUMENTS

CN 1011759892 A 5/2008
CN 104417476 A 3/2015
(Continued)

*Primary Examiner* — S. Joseph Morano
*Assistant Examiner* — Cheng Lin
(74) *Attorney, Agent, or Firm* — James D. Miller; Shumaker, Loop & Kendrick, LLP

(57) ABSTRACT

A regenerative energy absorption device for damping forces which occur during operation of a track-guided vehicle, in particular tensile, impact and/or torsional forces, wherein the energy absorption device includes at least one spring device with an elastomer body which is designed so as to at least partially deform elastically when forces are introduced into the energy absorption device, wherein the elastomer body is at least partially formed from an electrically conductive material, the specific electrical resistance of which varies under tensile and/or compressive load, and wherein the energy absorption device is allocated a resistance sensor device for detecting electrical conductivity or electrical resistance of the electrically conductive material.

16 Claims, 4 Drawing Sheets

(56) References Cited

U.S. PATENT DOCUMENTS

| | | | | |
|---|---|---|---|---|
| 2007/0255509 | A1 | 11/2007 | LeFebvre et al. | |
| 2011/0180684 | A1* | 7/2011 | West | F16F 1/3615 267/141 |
| 2014/0225391 | A1 | 8/2014 | Kuolt et al. | |
| 2015/0057893 | A1* | 2/2015 | Ikeda | B60R 19/34 701/45 |
| 2017/0320506 | A1* | 11/2017 | Keener | B61G 9/20 |

FOREIGN PATENT DOCUMENTS

| | | | | | |
|---|---|---|---|---|---|
| CN | 105431333 | A | | 3/2016 | |
| CN | 106626503 | A | | 5/2017 | |
| CN | 107685743 | A | * | 2/2018 | B61G 9/00 |
| DE | 102015122863 | A1 | * | 6/2017 | |
| EP | 1857342 | A1 | * | 11/2007 | B61G 11/16 |
| EP | 1925523 | A1 | * | 5/2008 | B61D 3/10 |
| EP | 2072370 | A1 | | 6/2009 | |
| EP | 2876421 | A1 | | 5/2015 | |
| EP | 2876421 | B1 | * | 7/2017 | F16L 11/085 |
| WO | 2005075272 | A1 | | 8/2005 | |
| WO | 2005117030 | A2 | | 12/2005 | |
| WO | 2017153149 | A1 | | 9/2017 | |
| WO | 2019211262 | A2 | | 11/2019 | |

* cited by examiner

REGENERATIVE ENERGY ABSORPTION DEVICE, COUPLING OR JOINT ARRANGEMENT HAVING AN ENERGY ABSORPTION DEVICE OF THIS KIND, AND DAMPING ARRANGEMENT HAVING AN ENERGY ABSORPTION DEVICE OF THIS KIND

CROSS-REFERENCE TO RELATED APPLICATIONS

This patent application is a United States national phase patent application based on PCT/EP2020/063452 filed on May 14, 2020, which claims the benefit of German Patent Application No. 10 2019 113 907.4 filed on May 24, 2019, the entire disclosures of which are hereby incorporated herein by reference.

FIELD

The present invention relates to a regenerative energy absorption device for damping forces which occur during (normal) operation of a track-guided vehicle, in particular tensile, impact and/or torsional forces.

The invention further relates to a coupling or joint arrangement of a track-guided vehicle, in particular a rail vehicle, for the articulated connection of two adjacent railcar bodies, wherein the coupling or joint arrangement comprises at least one energy absorption device of the aforementioned type.

BACKGROUND

The use of energy dissipation devices, particularly to protect against shock, is commonly known from rail vehicle technology. Such shock protection generally consists of a combination of a regeneratively functioning energy absorption device/damping device (for example in the form of a spring device) and a destructively designed energy absorption device. The regeneratively designed energy absorption device/damping device serves to dampen the tensile and impact forces which occur during normal vehicle operation while the destructively designed energy dissipation device protects the vehicle, particularly at higher impact velocities. It is normally provided for the regeneratively designed energy absorption device serving as a damping device to absorb tensile and impact forces up to a defined magnitude with the forces in excess thereof being transmitted to the vehicle undercarriage. The tensile and impact forces which occur for example in a multi-unit rail vehicle between the individual railcar bodies during normal vehicle operation are thereby absorbed in said regeneratively designed energy absorption device.

When the operating load of the regeneratively designed energy absorption device is exceeded, however, such as when for instance the vehicle hits an obstacle or the vehicle abruptly brakes or is coupled at excessive speed, there is the risk of possible damage or even destroying of the regeneratively designed energy absorption device serving as a damping device and any articulated or coupling connection which may be provided between the individual railcar bodies or, in general terms, the interface between the individual railcar bodies respectively.

In any case, the regeneratively designed energy absorption device serving as a damping device is insufficient with respect to absorbing the total resulting energy. Thus, the regeneratively designed energy absorption device is then no longer integrated into the energy dissipation concept of the overall vehicle.

In order to prevent the resulting impact energy in such a crash from being transmitted directly to the vehicle undercarriage, connecting an energy absorption device downstream of the regeneratively designed energy absorption device serving as a damping device is commonly known from rail vehicle technology. The energy absorption device usually responds after the operating load of the regeneratively designed energy absorption device serving as a damping device has been exceeded and serves to at least partially consume the resulting impact energy; i.e. convert it into thermal energy and deformation energy, for example. Providing such an energy dissipation device is generally recommended for reasons of derailment safety so as to prevent crash-resultant impact energy from being transmitted directly to the vehicle undercarriage and particularly to prevent the vehicle undercarriage from being subjected to extreme loads and possibly being damaged or even destroyed.

In order to ensure that the overall vehicle energy dissipation concept can effectively take into account situations which occur during both normal vehicle operation as well as crash situations, it needs to be ensured that all the energy dissipation devices and/or energy absorption devices integrated into the energy dissipation concept have not yet responded and/or are functioning properly. With respect to the destructively designed energy dissipation devices, known thereto for example from rail vehicle technology is for the energy dissipation device to conceivably comprise a type of "deformation indicator" which is designed to display the utilization of the energy dissipation element after and/or during the responding of the destructively designed energy dissipation device. Such a deformation indicator enables being able to easily determine whether or not the energy dissipation element of the energy dissipation device has already been (partially or fully) activated.

In this context, reference is made for example to the EP 2 072 370 A1 printed publication which describes one such (mechanical) deformation display for destructively designed energy dissipation devices. The deformation display known from this prior art has a trigger which responds upon a plastic deformation of the energy dissipation element and initiates the deformation display. Specifically, EP 2 072 370 A1 teaches the person skilled in the art to use a signal element, such as e.g. a signal plate, as a deformation display which is fixed to the energy dissipation element via a shearing element serving as a trigger, wherein the shearing element shears off upon a plastic deformation of the energy dissipation element and loses its retaining function such that the signal plate is then no longer fixed to the energy dissipation element and it can thus be easily recognized that the destructively designed energy dissipation element has already responded.

Although such a known per se solution can ensure that the destructively designed energy absorption devices of an energy dissipation device are effectively available and integrated into the overall energy dissipation concept of the vehicle, what is not ensured is that other components of the energy dissipation device, in particular regeneratively designed energy absorption devices, are still functioning properly even after a long period of operation. "Functioning properly" in this sense means that the response and damping behavior of the regeneratively designed energy absorption devices has not changed or not substantially changed compared to the original design.

On the other hand, the solution discussed above in conjunction with printed publication EP 2 072 370 A1 is not applicable to regeneratively designed energy absorption devices since the response of the deformation display known from this prior art requires a plastic deformation of the energy dissipation element, thus a non-regenerative deformation. Such non-regenerative deformation is generally not provided with energy absorption devices of the type considered herein.

SUMMARY

On the basis of this problem as set forth, the present invention is based on the task of specifying a regeneratively designed energy absorption device which enables easily ensuring that shock absorbance always takes place as needed pursuant to a predefined or definable sequence of events without the individual components of the energy absorption device being individually and regularly checked to that end.

This task is solved according to the invention by the subject matter as disclosed herein.

Accordingly, the invention relates in particular to a regenerative energy absorption device for damping forces which occur during (normal) operation of a track-guided vehicle, in particular tensile, impact and/or torsional forces, wherein the energy absorption device comprises at least one spring device with an elastomer body which is designed so as to at least partially deform elastically when forces are introduced into the energy absorption device. The invention particularly provides for the elastomer body to be at least partially formed from an electrically conductive material, the specific electrical resistance of which varies under tensile and/or compressive load, wherein the energy absorption device is allocated a resistance sensor device for detecting electrical conductivity or electrical resistance of the electrically conductive material.

The advantages able to be achieved with the solution according to the invention are obvious: by the elastomer body of the spring device of the energy absorption device being at least partially made of an electrically conductive material, the material of the elastomer body, thus figuratively speaking the elastomer body itself, can be used as part of a sensor system designed to directly or indirectly determine or estimate a load change to which the elastomer body is subjected. This load change to which the elastomer body is subjected is in particular a mechanical tensile, compressive or torsional stress acting on the elastomer body of the spring device.

Thus, the functioning of the energy absorption device can be effectively monitored by means of the sensor system integrated at least partially into or in part of the material of the energy absorption device, and namely done so by, for example, the resistance sensor device detecting loads on the elastomer body when the energy absorption device transmits load over a predefined or definable period of time. From that, a total load change or a total load on the elastomer body or other components of the energy absorption device can be determined. In particular, information relating to maintenance and/or replacement of the elastomer body or another component of the energy absorption device can then be output as a function of the determined total load change and/or determined total load.

Alternatively or additionally, the resistance sensor device enables timely detecting degradations of the elastomer body's (elastomer) material as may occur during energy absorption device operation.

In particular, the resistance sensor device and the electrically conductive material of the elastomer body which constitutes part of a sensor system can thus effectively detect the incidence of operating states which lead particularly to not immediately apparent damaging or preliminarily damaging of the regenerative energy absorption device. Due to the provision of this sensor system (resistance sensor device in combination with the electrically conductive material of the elastomer body), a visual inspection can in particular be dispensed with during monitoring of the regeneratively designed energy absorption device.

Moreover, the resistance sensor device and the electrically conductive material of the elastomer body can effectively detect any wear or preliminary damage to other components, in particular the energy absorption device, including in particular the wearing of other regeneratively designed damping elements used in the energy absorption device such as e.g. elastomer bearings. This is particularly advantageous because—as is also the case with the elastomer body of the energy absorption device—these components are generally not freely accessible and a visual inspection check would thus be very laborious.

The inventive solution in particular enables the timely and reliable detecting and signaling of preliminary damage to the energy absorption device's components in order to thereby prevent possible consequential damages and associated failures of the overall system as a whole due to unscheduled maintenance work. The sensor system used to that end in the form of the resistance sensor device in combination with the electrically conductive material of the elastomer body is characterized by a compact and economical design such that free accessibility to the monitored components of the energy absorption device, and in particular the elastomer body of the energy absorption device, is no longer necessary.

In addition, an on-board diagnostic system can be implemented in order to enable the vehicle system to perform early diagnosis and simplify maintenance. With such an on-board diagnostic system, the vehicle system automatically queries the resistance sensor device or an evaluation device associated with the resistance sensor device respectively.

External sensors, particularly extensometers (strain gauges or clip gauges), are in particular also able to be dispensed with by the resistance sensor device detecting electrical conductivity or electrical resistance of the electrically conductive material of the elastomer body, whereby this data is then used as the basis for further evaluation. Particularly no longer necessary with the present invention is attaching, e.g. screwing, respective sensors to existing structures from the outside, which would consequently entail a structural change to the components and in particular the elastomer body of the energy absorption device. Nor does the electrically conductive material of the elastomer body, which figuratively assumes the function of an extensometer, influence the damping properties of the elastomer body such that the dynamic properties of the elastomer body remain unchanged.

Various solutions are feasible relative to forming the electrically conductive area in the material of the elastomer body. Provided according to preferential embodiments is for the electrically conductive material, or the electrically conductive area in the material of the elastomer body respectively, to be formed by at least one particularly metal-based or carbon-based filler network in a polymer material. The filler network is in particular formed by metal or carbon-based filler particles which are incorporated into a matrix of the polymer material. It is thereby advantageous for the polymer material of the electrically conductive material to correspond to a polymer material forming the elastomer body. By so doing, the integration of the "sensor system" into the elastomer body does not affect the elastomer body's dynamic damping behavior.

The solution according to the invention largely dispenses with adding separate active and/or passive structural elements to the energy absorption device. Forming an electrically conductive area in the material of the elastomer body does not require any electrical infrastructure adapted to the specific conditions during vehicle operation and needing to for example withstand local deformations of a high number of repetitions as well as temperature ranges between −50° to +50°.

It is of course possible to introduce carbon black-coated threads, carbon black dispersions (carbon black ink, carbon black paste, carbon black-containing solutions), threads which have been wetted with carbon black ink or carbon black paste, conductive (cross-linked) rubber threads or other similar elements to the electrically conductive material in the elastomer body. However, the dynamic behavior of the elastomer body is left completely unchanged when conductive fillers such as CNT (=carbon nanotubes), graphene, graphite or metal powder, in particular amorphous tin oxide, are embedded in the polymer material of the elastomer body.

According to embodiments of the invention, conductive materials such as carbon black, graphite, carbon, carbon nanotubes, copper, gold, silver, etc. are incorporated into the polymer matrix. These polymers form an electrically conductive network as of a certain degree of filling. If the polymer material is subjected to tensile loading or compressive loading, the resistance changes due to the narrowing cross-section and the change in particle distribution in the polymer matrix. This design enables different expansions of the elastomer body to be measured. Research in this field has shown that the elastic and electrically conductive material of the elastomer body can be used as sensor material for determining and measuring tensile loads or compressive loads. The sensory-related properties improve as the filling level of the polymer material increases, although the mechanical properties of the original polymer material diminish.

For this reason, it is advantageous to not mix the entire polymer material of the elastomer body with corresponding conductive particles but rather only for individual areas of the polymer material to be provided with a corresponding filler network. Advantageously, these areas are located in a region of the elastomer body through which at least one precalculated load path runs when damping ensues during the operation of the track-guided vehicle. The sensory-related properties of this electrically conductive area of the elastomer body are then utilized with the resistance sensor device to provide corresponding data indicative of a load change acting or having acted on the elastomer body and/or indicative of degrading of the material of the elastomer body.

According to implementations of the inventive energy absorption device, it is provided for the resistance sensor device to be designed so as to detect the electrical conductivity and/or the electrical resistance between at least two measuring points in the electrically conductive material of the elastomer body, whereby the resistance sensor device has at least one, preferably potential-free measuring sensor to that end. It is in particular conceivable in this context for the preferably potential-free measuring sensors to be arranged such that the electrical resistance or respectively electrical conductivity of the electrically conductive material in the elastomer body is determined over different spatial axes in order to obtain information on tensile loads or compressive loads or elastomer body strain loads respectively in different spatial axes.

The resistance sensor device preferentially comprises an interface device which in particular operates wirelessly, by means of which data collected and optionally evaluated by the resistance sensor device can preferably be at least partially read out via remote access.

It is thus for example conceivable for the resistance sensor device to be allocated a suitable evaluation device designed to appropriately evaluate the data collected by the resistance sensor device with respect to the electrical conductivity or electrical resistance respectively. According to embodiments of the present invention, to evaluate the determined conductivity or resistance data, this measurement data is compared to corresponding reference data, wherein the reference data was preferably recorded earlier during the course of a calibration. The invention is thereby based on the realization that mechanical wear of the elastomer body changes for example the elongation properties and thus the damping properties of the elastomer body and deviates from an ideal state (target state). The degree or respectively extent of the change/deviation from the target state can then serve as an indication of improper elastomer body functioning or elastomer body wear respectively.

Potential deviations in the functioning of the monitored elastomer body or potential wear of the elastomer body respectively are thus detected by the resistance sensor device and the electrically conductive area of the elastomer body material serving as sensor material and deviations from an expected target state are communicated either to the operator of the track-guided vehicle via error messages or to an appropriate maintenance service, in particular remote maintenance service, via a remote control interface.

The remote maintenance of the components of a track-guided vehicle is becoming increasingly important in supporting hardware and software from component suppliers to the rail vehicle technology sector. The ever increasing networking of control systems over the internet and establishment of internal company intranets and conventional telecommunication channels (ISDN, telephone, etc.) results in increasing direct support possibilities. Not least because of the potential travel costs savings and better use of resources (personnel and technology), remote maintenance products are used to lower company costs. Remote maintenance programs enable the remote service technician to directly access the monitored elastomer body or components of the energy absorption device respectively and query their status in order to plan and perform predictive countermeasures such as e.g. maintenance periods.

According to embodiments of the invention, the resistance sensor device is allocated a storage device for storing strains, compressions and shear stresses or other relevant information and data respectively introduced into the elastomer body particularly during operation of the rail vehicle, whereby the storage device is in particular designed to preferably permanently save all the data and information collected by the resistance sensor device at least for a predefined or definable period of time. It thereby makes sense for the storage device to be designed to be able to be at least partially read out, preferably via remote access.

By storing information and data relevant to the operation of the monitored elastomer body, and in particular strains, compressions and shear stresses of the elastomer body during operation of the rail vehicle, the corresponding operation and loading of the elastomer body can be documented in order to also be able to predictively plan maintenance periods.

In particular provided according to embodiments of the present invention is for the resistance sensor device to be allocated a storage device for documenting elastomer body loads (strains, compressions and shear stresses in different spatial directions) occurring over a predefined or definable period of time during load transmission. It is advisable in this context for an evaluation device to be provided for determining a total load change and/or a total load on the elastomer body, and that on the basis of the documented loads. In conjunction thereto, the evaluation device should further be designed to output information relating to maintenance and/or replacement of the elastomer body and/or another component of the energy absorption device as a function of the total determined load change and/or the total determined load.

The invention is thereby based on the realization that components of the energy absorption device such as e.g. the elastomer body need to be replaced or serviced when the tolerable loads add up to a strictly defined value. Inspection or maintenance has to date drawn on documentation of the annual load changes, this usually being based on an estimate. This gives rise to great inaccuracy as it is not actually known exactly how many load changes actually took place and how high the loading was.

There can preferably be simultaneous documentation of the load collective with the present invention, this enabling a greater utilization factor for the components of the energy absorption device or the elastomer body respectively. Particularly the service life of the energy absorption device's components can thereby be increased. Early detection of when and which components of the energy absorption device need to be replaced is further possible. As a result, a respective replacement can be procured in advance, minimizing downtimes and significantly increasing process reliability.

In this context, it is entirely conceivable for the evaluation device to be allocated at least one display device, in particularly in the form of a display and/or at least one light source for optically displaying the total determined load change and/or the total determined load and/or corresponding related information.

Alternatively or additionally, it makes sense for the evaluation device to have a digital interface, in particular a Modbus, CAN, CANopen, IO-Link and/or Ethernet compatible interface, in order to be able to accordingly communicate with an external device. Doing so enables on-board diagnostics in particular to be realized so as to allow early stage vehicle system diagnosis and simplify maintenance. With such on-board diagnostics, the vehicle system preferably automatically queries the evaluation device or the corresponding resistance sensor device.

The at least one area made of the electrically conductive material is preferably formed in a region of the elastomer body which is often subjected to repetitive expansions, compressions and/or shear stresses during the track-guided vehicle's operation.

As already stated, it is preferably provided within the scope of the present invention for the area with the electrically conductive material to be formed by at least one particularly metal-based or carbon-based filler network in a polymer material, whereby metal or carbon-based filler particles incorporated into a matrix of the polymer material are thereby in particular used. According to embodiments of the present invention, different electrically conductive carbon allotropes which can differ in their geometric structures are used as fillers. For example, carbon black (CB), which typically consists of almost spherical particles 50 nm in diameter, can be used as filler. In all three dimensions, expansion is in the nanometer range. Alternatively or additionally thereto on the other hand, also able to be used as filler are carbon nanotubes (CNT) resembling the shape of a cylinder and exhibiting a radius in the range of a few nanometers and a length in the micrometer range. Graphene nanoplatelets (GNT), the structure of which resembles small plates, can also be used as a further filler. The thickness is thereby in the range of a few nanometers while the lateral expansion of the platelets is in the micrometer range.

Alternatively or additionally thereto, it is of course also conceivable for the filler network to be at least partially formed by textiles and metallic reinforcements provided with an electrically conductive fiber or an electrically conductive coating and embedded in the elastomer material of the elastomer body. In this case, these textiles and metallic reinforcements already integrated into the elastomer material can be used as electrically conductive paths.

The inventive energy absorption device can in particular be part of a coupling or joint arrangement of a track-guided vehicle, whereby said coupling or joint arrangement serves the articulated connection of two adjacent railcar bodies.

A further possible application is using the energy absorption device in a damping arrangement, for example in a side buffer of a track-guided vehicle.

In these applications, the provision of the resistance sensor device and the sensor material formed in the material of the elastomer body (the electrically conductive area) make it possible to intelligently monitor the functioning of the coupling or joint arrangement or the damping arrangement respectively.

Loads on the elastomer body occurring during load transmission are thereby detected over a predefined or definable period of time via the resistance sensor device and a total load change or a total load preferably determined therefrom, whereby information relating to maintenance and/or replacement of a component of the energy absorption device is output as a function of the total determined load change and/or as a function of the total determined load.

In order to enable the resistance sensor device to operate as independently as possible, and particularly to avoid complex cabling of the resistance sensor device to the vehicle body, it is in particular provided for the resistance sensor device to be designed to only detect an electrical conductivity or an electrical resistance of the electrically conductive area in the elastomer material at predefined or definable times and/or upon predefined or definable events (for example during a coupling operation). It is for example conceivable in this context for the resistance sensor device to be activated (triggered) as soon as a corresponding sensor system detects the introduction of a force into the energy absorption device which exceeds a predefined threshold value.

Doing so enables minimizing the resistance sensor device's consumption of electrical energy.

According to further developments of in particular the latter aspect, the resistance sensor device has at least one generator, in particular a nanogenerator, in order to realize the "energy harvesting" concept. With this generator, nanogenerator in particular, the resistance sensor device can obtain at least part of the electrical energy which the resistance sensor device requires during operation from the resistance sensor device's immediate surroundings. It is for example conceivable for the nanogenerator to serve in obtaining appropriate electrical energy from a vibration of the elastomer body. Advantageously, a low-power near-field communication (NFC) solution, for example ZigBee or Bluetooth LE or another suitable standard, can appropriately be used to transmit the information obtained by the resistance sensor device to the nearest data interface.

This aspect makes a completely wireless implementation of the resistance sensor device conceivable, whereby constraints due to a wired power supply or batteries and/or wired communication technologies are eliminated.

DESCRIPTION OF DRAWINGS

The following will reference the drawings in describing the invention in greater detail on the basis of exemplary embodiments.

Shown are.

DETAILED DESCRIPTION OF AN EMBODIMENT

Figure 1:
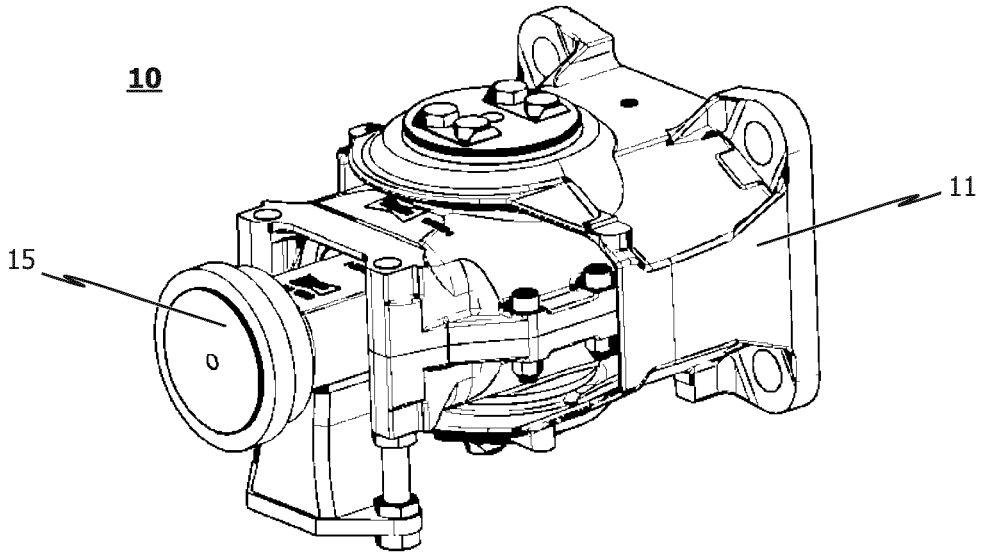
FIG. 1 a schematic and isometric view of a first embodiment of a coupling linkage for a central buffer coupling of a track-guided vehicle, in particular a rail vehicle, wherein an exemplary embodiment of the energy absorption device according to the invention is used in said coupling linkage.

FIG. 1 shows a schematic and isometric view of a coupling linkage 10 of a central buffer coupling for rail vehicles, whereby an exemplary embodiment of the energy absorption device according to the invention is used in this coupling linkage 10. The FIG. 2 depiction shows the coupling linkage 10 according to FIG. 1 in a side sectional view.

An energy absorption device having a total of three spring devices, each with a respective annular elastomer body 1, is integrated into the coupling linkage 10 as depicted. These annular elastomer bodies 1 of the spring devices are configured so as to absorb tensile and impact forces up to a defined magnitude, with the forces in excess thereof being transmitted to the vehicle undercarriage via the bearing block 11.

Figure 2:
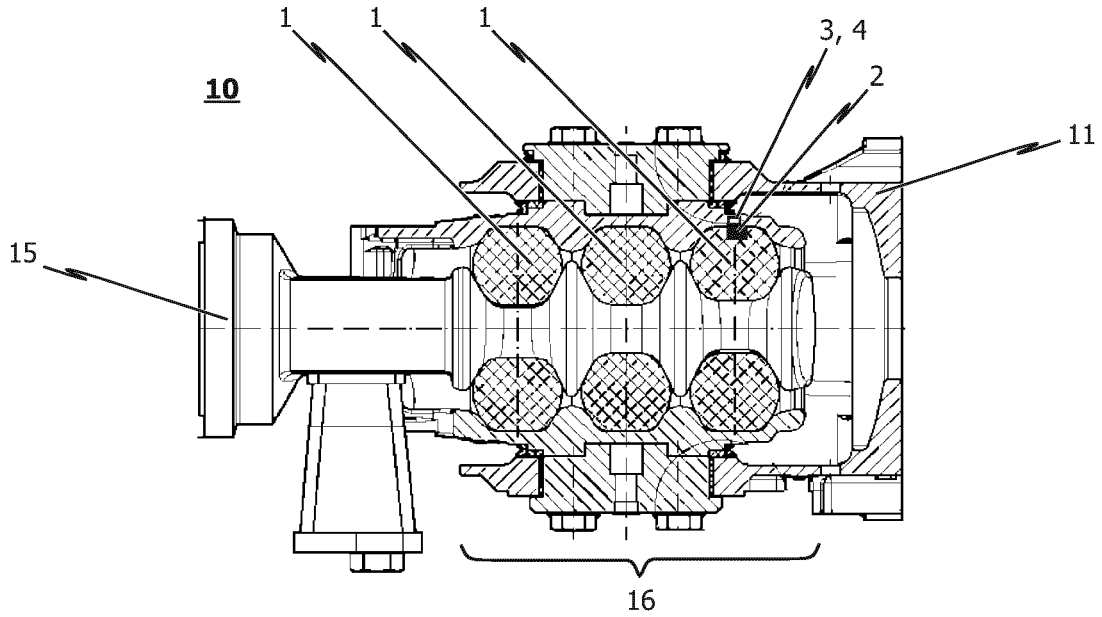
FIG. 2 the coupling linkage according to FIG. 1 in a side sectional view.

The coupling linkage 10 depicted in FIGS. 1 and 2 comprises the rear part of a coupling arrangement and serves to articulate the coupling shaft 15 of a central buffer coupling to a railcar body mounting plate (not shown in the drawings) via the bearing block 11 so as to be horizontally pivotable.

Since the regenerative energy absorption device with the annular elastomeric bodies 1 serving as a damping device is accommodated within the bearing block 11 in the coupling linkage 10 depicted in FIG. 1 and FIG. 2, the bearing block 11 exhibits a configuration adapted with respect to the annular elastomeric body 1. Specifically, the bearing block 11 exhibits a cage or housing structure 16 via which the bearing shells of the bearing are connected to a vertically extending flange.

During coupling linkage 10 operation, tensile or compressive forces are introduced into the energy absorption device via the coupling shaft 15. Specifically, when tensile or compressive forces are introduced, the coupling shaft 15 moves relative to the cage or housing structure 16 of the bearing block 11, whereby the elastomer body 1 of the energy absorption device is thereby correspondingly deformed so as to dampen the transmitted tensile or compressive forces.

As indicated schematically in FIG. 2, part of an elastomer body 1 of the energy absorption device accommodated in the cage/housing structure 16 of the bearing block 11 is formed from an electrically conductive material 2 in this exemplary embodiment, whereby this region serves as sensor material. The electrically conductive material 2 of the elastomer body 1 is designed such that its specific electrical resistance or its electrical conductivity respectively varies given the area of electrically conductive material 2 being subjected to tensile and/or compressive loads.

The electrically conductive area 2 of the elastomer body 1 is advantageously formed by a filler network comprising metal-based or carbon-based filler particles. The filler network, or the filler particles respectively, are accommodated in a matrix of the polymer material from which the typical area of the elastomer body 1 is also formed.

Although not able to be directly inferred from the FIG. 2 schematic representation, the at least one electrically conductive area 2 of the material of the elastomer body 1 is formed in an area of the elastomer body 1 in which a load path preferably runs in a specific spatial direction when pressure or tension is transmitted or introduced into the energy absorption device respectively.

The electrical conductivity or, respectively, the electrical resistance of the area 2 of the elastomer body 1 serving as sensor material is measured or respectively detected by means of a resistance sensor device 3. The resistance sensor device 3 comprises at least one preferably potential-free measuring sensor to that end. One embodiment of such a resistance sensor device 3 is described in greater detail below with reference to the depiction in FIG. 5.

Figure 3:
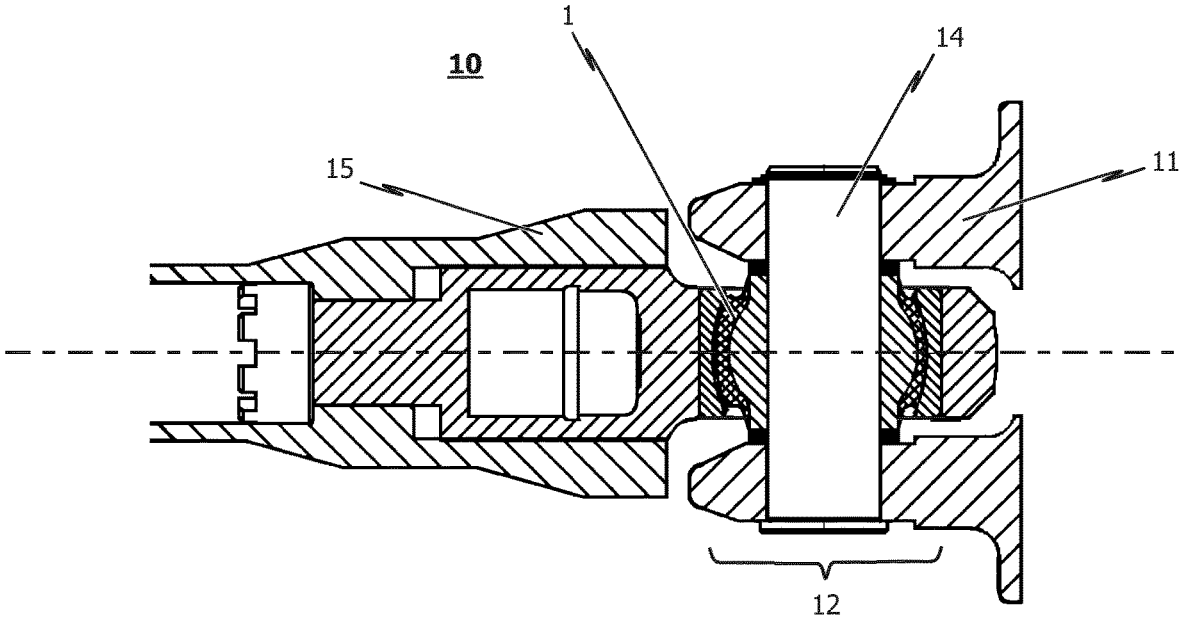
FIG. 3 a schematic and side sectional view of a second embodiment of a coupling linkage for a railcar body of a multi-unit vehicle with an exemplary embodiment of the inventive energy absorption device.

A further exemplary possible application of the inventive energy absorption device is shown in FIG. 3 in a schematic longitudinal sectional view. In detail, FIG. 3 shows a coupling linkage 10 with an embodiment of the inventive energy absorption device in a schematic and side sectional view. The energy absorption device is in this case designed as a spherical bearing 13.

Specifically, the coupling linkage 10 according to FIG. 3 comprises a bearing block 11 essentially rigidly mounted to an end face of a railcar body as well as a joint arrangement 12 with a regenerative energy absorption device in the form of a spherical bearing and a vertically extending pivot pin 14. The joint arrangement 12 serves to articulately connect a coupling rod 15 to the bearing block 11, wherein the railcar body-side end section of the coupling rod 15 is connected to the bearing block 11 via the joint arrangement 12 so as to enable at least some extent of horizontal and vertical movement of the coupling rod 15 relative to the bearing block 11.

In detail, a horizontal pivoting of the coupling rod 15; i.e. a pivoting of the coupling rod 15 within the horizontal coupling plane, is possible due to the provision of the pivot pin 14 extending vertically to the horizontal coupling plane.

The vertical central longitudinal axis, which is perpendicular to the horizontal coupling plane, runs through pivot pin 14. The intercept point between the central longitudinal axis and the horizontal coupling plane indicates the center of rotation about which the coupling rod 15 is horizontally or vertically pivotable relative to the bearing block 11 essentially rigidly flange-mounted or otherwise mounted to the railcar body.

A regenerative energy absorption device is provided in the joint arrangement 12 of the embodiment depicted in FIG. 3, this serving to dampen the tensile or compressive forces introduced via the coupling rod 15 during normal vehicle operation. The energy absorption device is part of a spherical bearing 13 and comprises a spring device with an elastomer body 1 designed so as to at least partially deform when forces are introduced into the energy absorption device.

Figure 4:
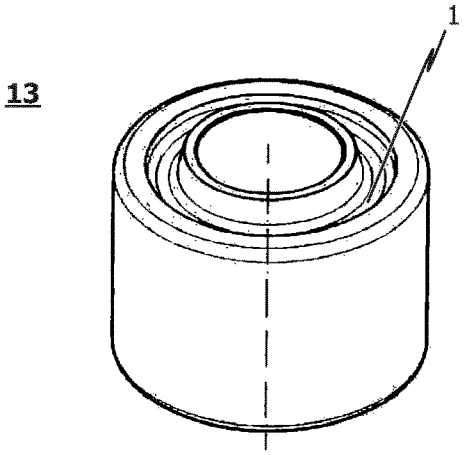
FIG. 4 a schematic and isometric view of the energy absorption device ("spherical bearing") used in the coupling linkage according to FIG. 3.
Figure 5:
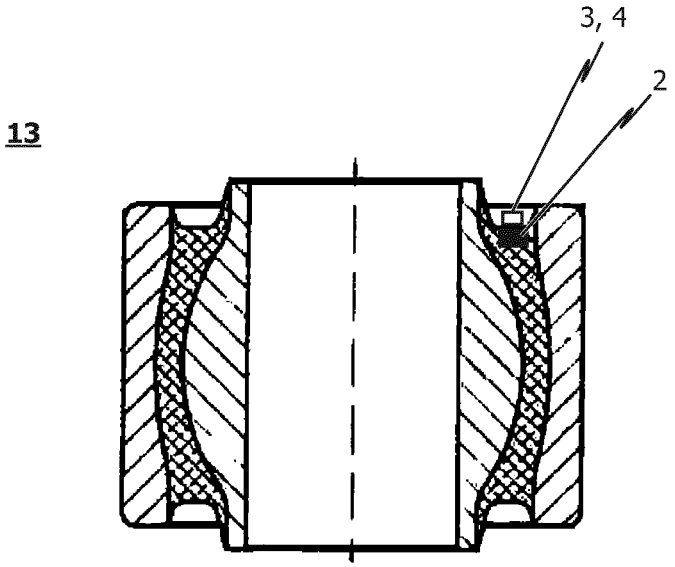
FIG. 5 a schematic and sectional view of the energy absorption device according to FIG. 4.

One embodiment of the spherical bearing 13 used in the joint arrangement 12 according to FIG. 3 is shown in a schematic and isometric view in FIG. 4 and in a corresponding sectional view in FIG. 5.

As can be seen in particular from the sectional view according to FIG. 5, the elastomer body 1 of the energy absorption device is at least partially formed from an electrically conductive material 2. As with the previously described embodiment according to FIG. 1/FIG. 2, the electrically conductive area 2 of the elastomer body 1 material is designed such that its specific electrical resistance or its electrical conductivity respectively varies under tensile and/or compressive load.

The elastomer body 1 according to FIG. 5 is moreover allocated a resistance sensor device 3 able to detect an electrical conductivity or an electrical resistance of the electrically conductive material area 2 of the elastomer body 1.

One embodiment of the resistance sensor device 3 will be described in greater detail in the following with reference to the circuit diagram according to FIG. 6.

Figure 6:
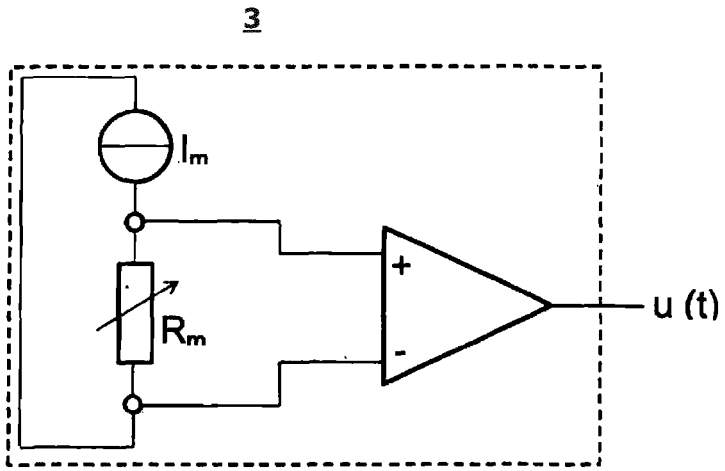
FIG. 6 the circuit diagram of an exemplary embodiment of a resistance sensor device of the inventive energy absorption device.
Figure 7:
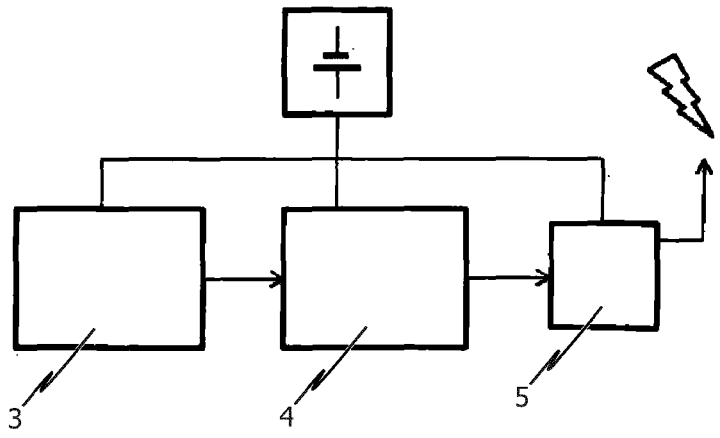
FIG. 7 a schematically depicted further embodiment of a resistance sensor device with an evaluation device and interface device of the inventive energy absorption device.

The resistance sensor device 3 shown schematically in FIG. 6 using a circuit diagram or equivalent circuit diagram respectively serves to detect the conductivity or electrical resistance respectively between at least two points in the electrically conductive elastomer material 2 of the elastomer body 1 by means of a dedicated measuring sensor. This can ensue for example with an arrangement as per FIG. 6 which measures differentially without reference potential.

The optimal position of the respective measuring points in the elastomer material 2 needs to be determined as a function of the geometry of the elastomer body 1. The measuring range of the conductivity or respectively electrical resistance ($R_m$) of the electrically conductive elastomer body material serving as the sensor material is to be determined subject to the given elastomer mixture. The frequency bandwidth of the identified signal u(t) is essentially determined via the bandwidth of the mechanical (dynamic) load that occurs.

In order to limit the range of electrical conductivity change, changes in the elastomer's composition or manufacturing process respectively are also conceivable depending on the additional mechanical properties of the respective elastomer or rubber mixture to be maintained. This even allows the characteristic values of the electrical conductivity to be set within certain limits subject to the mechanical load that occurs.

Since in certain circumstances the absolute values of the conductivity of the electrically conductive area of the elastomer body 1 can vary significantly, it is expedient to only detect the changes in the electrical conductivity or respectively electrical resistance $R_m$ following a calibration process. In addition to the mechanical home position (rest position), the calibration process should also encompass the specified end positions of the relevant overall system (in the case of train couplings: the operational lateral and vertical deflections). The magnitude or amount of the change in resistance can then be a measure of the mechanical load occurring on the integrated elastomer body 1.

Given an arrangement comprising a plurality of measuring sensors, e.g. in logically selected spatial axes, it is further conceivable to determine a vector (magnitude and direction) of the mechanical load or, respectively, deflection angle of the integrated component.

Changes in the resistance value $R_m$ in the mechanical home position (rest position) can in certain circumstances directly indicate a structural change in the elastomer material, a change in the ambient temperature, or aging of the elastomer material.

Conceivable relative to providing an advantageous measuring arrangement design is for it to be fully integrated directly on or in the elastomer body 1 or on its surface respectively during the manufacturing process in the form of a miniaturized "elastomer sensor" with evaluation device 4, energy supply, and in particular wireless data transmission 5 (e.g. NFC) as per FIG. 6. Communication is then made to a receiver located in the vicinity. This would have the advantage of there being no need for complicated wiring of the measuring sensor to the evaluation device 4.

Using the invention in a spherical bearing 13 in an automatic train coupling is seen as a preferential embodiment since changes in the mechanical load, or deflections of the supported component (e.g. coupling rod 15) respectively, are even possible in multiple spatial axes.

Advantageous for the practical operation of the resistance sensor device 3 is having the resistance sensor device 3 only measure at specific discrete times in order to limit the energy requirement. It is also conceivable for an external event to trigger the measurement such as, for example, coupling operations, tractive/braking actions of the track-guided vehicle, cornering through curves, or upon integrating an additional inertial encoder (acceleration) into the sensor for compression/traction in the coupling line.

Being able to make use of energy harvesting to obtain the energy required for operation from the natural movement (flexing) of the rubber material would also be an advantageous embodiment of the elastomer sensor.

In summary, it can be established that the provision of conductive fillers in the elastomer material of the elastomer body 1 creates electrically conductive areas 2 in the elastomer body 1. In the present invention, the specific property of the electrically conductive area 2 of the elastomer body 1 is rendered useful, and that by way of measuring and correspondingly evaluating a change in electrical conductivity under mechanical loading during operation of the energy absorption device. It is thereby possible to use the changes in the electrical conductivity in the elastomer body 1 induced by mechanical loading to infer the loading of elastomer body 1, or the energy absorption device respectively (magnitude and direction), as well as extraordinary loading conditions or aging of the component upon deviations. This thereby enables e.g. a condition-based maintenance of the components of the energy absorption device.

The invention is not limited to the embodiments illustrated in the drawings but rather yields from an integrated overall consideration of all the features disclosed herein.

LIST OF REFERENCE NUMERALS

1 elastomer body
2 electrically conductive area in elastomer body/sensor region
3 resistance sensor device
4 evaluation device
5 interface device
10 coupling linkage
11 bearing block
12 joint arrangement
13 spherical bearing
14 pivot pin
15 coupling rod
16 cage/housing structure

The invention claimed is:

1. A regenerative energy absorption device for damping forces which occur during operation of a track-guided vehicle, wherein the energy absorption device comprises:

at least one spring device with an elastomer body which at least partially deforms elastically when forces are introduced into the energy absorption device, wherein the elastomer body is at least partially formed from an electrically conductive material, wherein an electrical resistance of the electrically conductive material varies under tensile and/or compressive load, and wherein the energy absorption device includes a resistance sensor device for detecting an electrical conductivity or an electrical resistance of the electrically conductive material.

2. The energy absorption device according to claim 1, wherein the electrically conductive material is formed by at least one metal or carbon-based filler network in a polymer material.

3. The energy absorption device according to claim 2, wherein the filler network is formed by metal or carbon-based filler particles incorporated into a matrix of the polymer material.

4. The energy absorption device according to claim 2, wherein the polymer material of the electrically conductive material corresponds to a polymer material forming the elastomer body.

5. The energy absorption device according to claim 1, wherein the electrically conductive material is integrated into at least one area of the elastomer body through which at least one load path runs when the forces which occur during the operation of the track-guided vehicle are being damped.

6. The energy absorption device according to claim 1, wherein the resistance sensor device detects the electrical conductivity and/or the electrical resistance between at least two measuring points in the electrically conductive material, and wherein the resistance sensor device further comprises at least one measuring sensor which measures differentially without reference potential.

7. The energy absorption device according to claim 1, wherein the resistance sensor device further comprises a wireless interface device, by means of which data collected and optionally evaluated by the resistance sensor device can be at least partially read out via remote access.

8. The energy absorption device according to claim 7, wherein the resistance sensor device further comprises a storage device which permanently stores at least some of the data and information collected and/or optionally evaluated by the resistance sensor device, and wherein the storage device is at least partially read out via remote access.

9. The energy absorption device according to claim 1, wherein the resistance sensor device only detects the electrical conductivity or the electrical resistance of the electrically conductive material at predefined or definable times and/or upon predefined or definable events.

10. The energy absorption device according to claim 1, wherein the resistance sensor device further comprises at least one generator to obtain at least part of an electrical energy which the resistance sensor device requires during operation.

11. The energy absorption device according to claim 1, wherein the resistance sensor device further comprises an evaluation device or wherein the resistance sensor device is allocated an evaluation device, wherein the evaluation device evaluates measured values collected by the resistance sensor device, wherein the evaluation device uses data collected by the resistance sensor device for the electrical conductivity and/or the electrical resistance to check whether the elastomer body of the spring device is designed for loads acting on the energy absorption device during operation of the track-guided vehicle.

12. The energy absorption device according to claim 11, wherein the evaluation device further comprises a storage device with reference data recorded during a calibration.

13. The energy absorption device according to claim 11, wherein the evaluation device determines a total load change or a total load on the elastomer body, and that on the basis of a load on the elastomer body documented by the evaluation device and occurring over a predefined or a definable period of time, and wherein the evaluation device outputs information relating to maintenance and/or replacement of the elastomer body as a function of a total determined load change or as a function of a total determined load of the elastomer body.

14. A coupling or a joint arrangement of the track-guided vehicle for an articulated connection of two adjacent railcar bodies, wherein the coupling or the joint arrangement further comprises the energy absorption device according to claim 1.

15. A damping arrangement in the form of a side buffer of the track-guided vehicle, wherein the damping arrangement further comprises the energy absorption device according to claim 1.

16. The energy absorption device according to claim 10, wherein the at least one generator is a nanogenerator.

* * * * *